US008113417B2

(12) United States Patent
Stude

(10) Patent No.: US 8,113,417 B2
(45) **Date of Patent: *Feb. 14, 2012**

(54) EASY OPEN ENVELOPE

(76) Inventor: Michael Stude, Barrington, IL (US)

( * ) Notice: Subject to any disclaimer, the term of this patent is extended or adjusted under 35 U.S.C. 154(b) by 279 days.

This patent is subject to a terminal disclaimer.

(21) Appl. No.: 11/533,252

(22) Filed: Sep. 19, 2006

(65) Prior Publication Data

US 2007/0023492 A1 Feb. 1, 2007

Related U.S. Application Data

(63) Continuation of application No. 10/650,882, filed on Aug. 28, 2003, now Pat. No. 7,178,713.

(51) Int. Cl.
*B65D 27/34* (2006.01)
*B65D 27/32* (2006.01)

(52) U.S. Cl. ..... 229/313; 229/308

(58) Field of Classification Search ..... 229/313, 229/307, 316, 308–311, 314, 315
See application file for complete search history.

(56) References Cited

U.S. PATENT DOCUMENTS

| | | | | | |
|---|---|---|---|---|---|
| 341,297 | A | * | 5/1886 | White | 229/316 |
| 913,919 | A | | 3/1909 | Sales | |
| 1,044,935 | A | | 11/1912 | Snider | |
| 1,328,028 | A | | 1/1920 | Ahana | |
| 1,362,779 | A | | 12/1920 | Cemicky | |
| 1,957,684 | A | | 5/1934 | Will | |
| 2,310,371 | A | * | 2/1943 | Lines et al. | 206/455 |
| 2,317,335 | A | * | 4/1943 | Whitman | 229/305 |
| 3,104,048 | A | | 9/1963 | Lemiesz | |
| 3,318,510 | A | * | 5/1967 | Quarles, III | 229/313 |
| 3,655,120 | A | | 4/1972 | Stern | |
| 4,313,557 | A | * | 2/1982 | Foffel | 229/68.1 |
| 4,688,715 | A | * | 8/1987 | Barr | 229/302 |
| 5,505,376 | A | | 4/1996 | Kent et al. | |
| 5,570,835 | A | | 11/1996 | Sung et al. | |
| 5,738,274 | A | | 4/1998 | Stude | |
| 5,961,436 | A | | 10/1999 | Ding | |

(Continued)

FOREIGN PATENT DOCUMENTS

| | | |
|---|---|---|
| CA | 0636634 | 2/1962 |

(Continued)

*Primary Examiner* — Jes F Pascua
(74) *Attorney, Agent, or Firm* — Thomas R. Vigil

(57) ABSTRACT

The easy open envelope comprising a front panel and a back panel hingedly connected to one edge of the front panel; a sealing flap connected to the opposite edge of the front panel at a fold line and having on an outer side of the sealing flap in one corner section thereof a legend or indicia indicating where to pull on the corner section of the sealing flap to open the envelope; and a strip of adhesive sealing material extending longitudinally across the envelope on one of the sealing flap or back panel of the envelope in the area where the sealing flap overlies the back panel, but not in the area of the corner section, whereby, once the sealing flap is sealed by the strip of adhesive material to the back panel, the sealed envelope easily can be opened by pulling on an edge of the corner section of the sealing flap having the legend to create an opening in the sealed envelope where a finger or tool can be inserted to open the envelope along the fold line. Preferably, a transverse line of perforations is provided in the sealing flap between the corner section and the remainder of the sealing flap having the strip of adhesive material there-beneath for adhering the sealing flap to the back panel.

4 Claims, 4 Drawing Sheets

U.S. PATENT DOCUMENTS

| | | | | |
|---|---|---|---|---|
| 6,123,256 | A | 9/2000 | Landis | |
| 6,223,977 | B1 * | 5/2001 | Hill | 229/70 |
| 6,491,213 | B2 * | 12/2002 | Purcell | 229/309 |
| 6,588,653 | B1 | 7/2003 | Schmidt | |
| 7,178,713 | B2 * | 2/2007 | Stude | 229/313 |

FOREIGN PATENT DOCUMENTS

| | | |
|---|---|---|
| FR | 1324132 | 3/1963 |
| GB | 0260859 | 11/1926 |

* cited by examiner

EASY OPEN ENVELOPE

This application is a continuation of application Ser. No. 10/650,882, filed Aug. 28, 2003, now U.S. Pat. No. 7,178, 713.

BACKGROUND OF THE INVENTION

1. Field of the Invention

The present invention relates to an easy open envelope which has structure and/or a legend on a corner of an envelope sealing flap for indicating to a receiver of the sealed envelope where to pull the corner of the sealing flap to tear open the sealing flap for inserting an object such, as a finger or pencil, to open the envelope.

2. Description of the Prior Art

Heretofore various envelope structures have been proposed which utilize perforated lines on a sealing flap and tabs, strings, line members and/or cords for facilitating opening of a sealed envelope.

Several examples of prior art envelope structures for facilitating easy opening of an envelope are disclosed in the following U.S. and Foreign patents.

U.S. Patent No. Patentee
U.S. Pat. No. 913,919 Sales
U.S. Pat. No. 1,044,935 Snider
U.S. Pat. No. 1,328,028 Ahana
U.S. Pat. No. 1,362,779 Cernicky
U.S. Pat. No. 1,957,684 Will
U.S. Pat. No. 3,104,048 John
U.S. Pat. No. 3,655,120 Stern
U.S. Pat. No. 5,505,376 Kent et al.
U.S. Pat. No. 5,570,835 Sung et al.
U.S. Pat. No. 5,738,274 Stude
U.S. Pat. No. 5,961,436 Ding
U.S. Pat. No. 6,123,256 Landis
U.S. Pat. No. 6,588,653 Schmidt
Foreign Patents
GB 0260859
CA 0636634
FR 1324132

The Kent et al. U.S. Pat. No. 5,505,376 proposes a mailing envelope which may be opened by grasping a graspable tear-out tab having a line member adhered thereto and pulling the tab and subsequently the line member away from the envelope to cause a line member to tear through the envelope along the length of the line member. Preferably, the line member is secured to a sealing flap of the envelope and along the fold line between the sealing flap and a panel of the envelope.

BRIEF SUMMARY OF THE INVENTION

As will be described in greater detail hereinafter, the easy open envelope of the present invention does not utilize a line member but utilizes special placement of a strip of sealing adhesive between a sealing flap and a panel of an envelope, a fold line between the sealing flap and a panel of the envelope and a legend or indicia placed on the outside surface of a corner section of the sealing flap thereby to indicate to a user where to tear open the sealing flap for inserting a finger or tool for opening the envelop along the fold line.

More specifically, the strip of sealing adhesive extends between side edges of the envelope on the sealing flap or along the upper margin of a panel of the envelope to which the sealing flap is adhered.

According to the teachings of the present invention, the strip of sealing adhesive does not extend completely across the sealing flap or the upper margin of the adjacent panel of the envelope, but ends a short distance from one side edge of the envelope so as to provide a corner section of the sealing flap which is not adhered to the adjacent panel thereby to enable the corner section to be easily torn away from the envelope to provide an opening for inserting a finger or tool to open the envelope along the fold line.

According to another aspect of the present invention, a transverse line of perforations, transverse to the perforated line, can be placed in the sealing flap at the location where the strip of sealing adhesive ends to further facilitate easy tearing of the corner section away from the envelope.

Still further, according to the present invention, a perforated line can be provided at or on the fold line between the sealing flap and the adjacent panel of the envelope, such as a front panel of the envelope.

Finally, according to a still further aspect of the present invention, the legend, "OPEN HERE" is placed on the corner section of the sealing flap to indicate to the user where to open the envelope.

In use, a user would see the legend stating "OPEN HERE" and grasp the flap and pull up the corner section (FIG. 8) to the top edge of the envelope thereby providing a space where a finger, a pencil or a tool, such as an envelope opener, easily can be inserted into the envelope to enable the user to open the envelope by pushing a finger or tool against the fold line/line of perforations between the sealing flap and the panel of the envelope to which it is attached.

In one embodiment of the present invention, the adjacent panel to which the sealing panel is attached has a generally rectangular marginal area on which a strip of adhesive is placed to form a resealing flap after the envelope is opened and the initial sealing flap is torn off.

In this embodiment the back panel to which the sealing flap is adhered only extends up to the beginning of this marginal area and not above it. Preferably, a fold line is provided in the panel having the marginal area at the junction between the marginal area and the rest of the panel.

Further, in this embodiment, an additional line of perforations can be provided in the sealing flap to facilitate removal of the rectangular area of the sealing flap which overlies and is juxtaposed to the marginal area in the adjacent (front) panel so that the second or resealing flap easily can be folded downwardly to reseal the envelope for remailing of the envelope.

According to the present invention there is provided an easy open envelope comprising a front panel and a back panel hingedly connected to one edge of the front panel; a sealing flap hingedly connected to the opposite edge of the front panel at a fold line and having on an outer side of the sealing flap in one corner section thereof a legend or indicia indicating where to pull on the corner section of the sealing flap to open the envelope; and a strip of adhesive sealing material extending longitudinally across the envelope on one of the sealing flap or back panel of the envelope in the area where the sealing flap overlies the back panel, but not in the area of the corner section, whereby, once the sealing flap is sealed by the strip of adhesive material to the back panel, the sealed envelope easily can be opened by pulling on an edge of the corner section of the sealing flap having the legend to create an opening in the envelope where a finger or tool can be inserted to open the sealed envelope along the fold line. Preferably, a transverse line of perforations is provided in the sealing flap between the corner section and the remainder of the sealing flap having the strip of adhesive material there-beneath for adhering the sealing flap to the back panel.

DETAILED DESCRIPTION OF THE INVENTION

Figure 1:
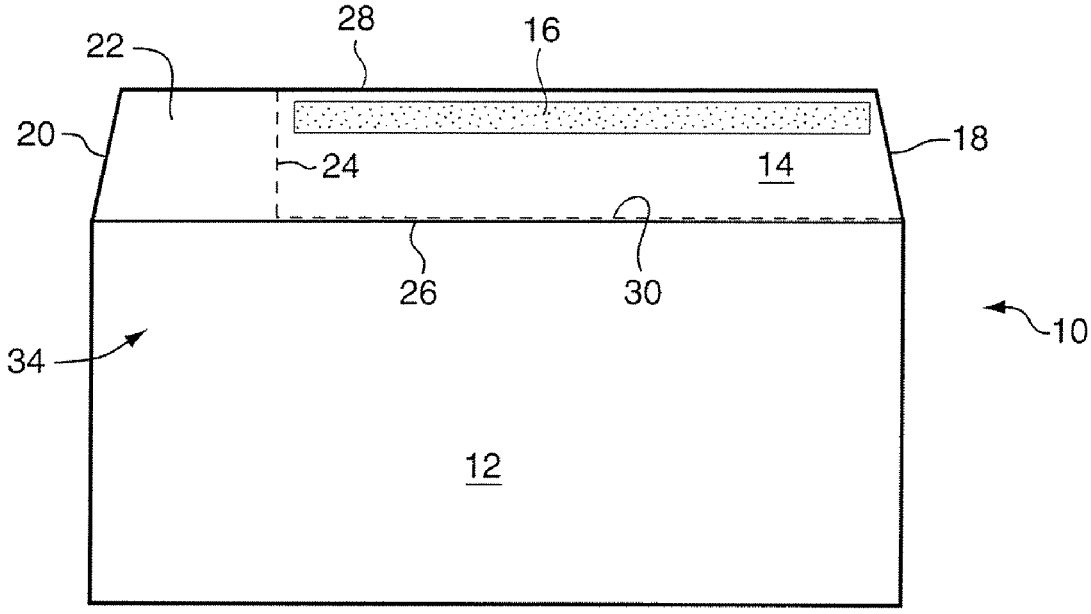
FIG. 1 is a plan view of the back side of an open envelope showing a sealing flap and a back panel onto which the sealing flap is folded downwardly and sealed.

Referring now to the drawings in greater detail, there is illustrated in FIG. 1, a back side of an open envelope 10 including a back panel 12 and a sealing flap 14. A strip of adhesive sealing material 16 is situated on one of the sealing flap 14 or the back panel 12 and is shown on the sealing flap 14.

According to the teachings of the present invention, the strip of adhesive sealing material 16 extends from a location adjacent one free side edge 18 of the sealing flap 14 adjacent to a location spaced from the other free side edge 20 of the sealing flap 14 thereby to leave a corner section 22 of the sealing flap 14 which does not have any adhesive sealing material thereon and which is therefore not adhered to the back panel 12.

In this embodiment, a transverse line of perforations 24 is also provided in the sealing flap 14 and extends from a fold line 26 between the sealing flap 14 and a front panel (hidden from view) and an outer free edge 28 of the sealing flap 14. Also it will be understood that a line of perforations 30 can be provided on or adjacent the fold line 26 between the sealing flap 14 and the front panel of the envelope 10.

Figure 2:
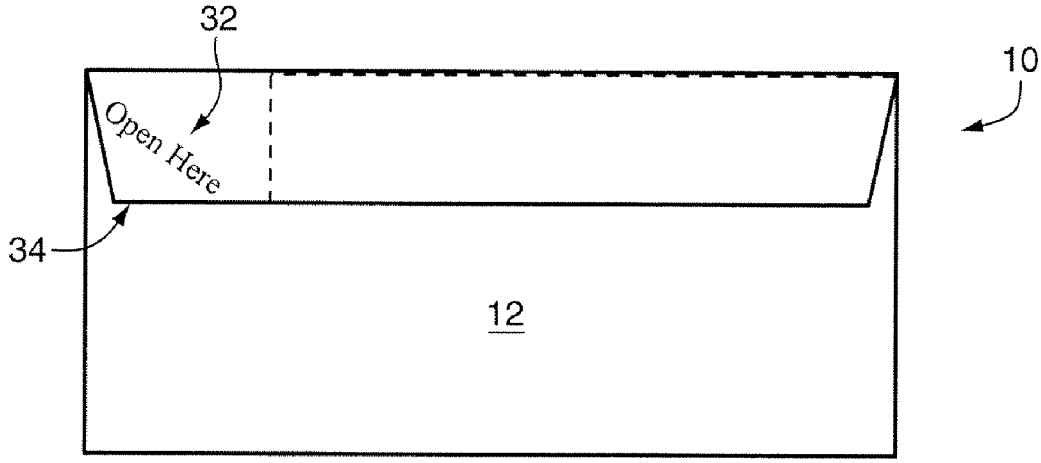
FIG. 2 is a plan view of the back side of the envelope shown in FIG. 1 after the sealing flap is sealed to the back panel.

FIG. 2 shows the sealing flap 14 folded onto and sealed onto the back panel 12 and shows the corner section 22 having a legend or indicia 32 thereon, such as "TEAR HERE" or "OPEN HERE".

Figure 8:
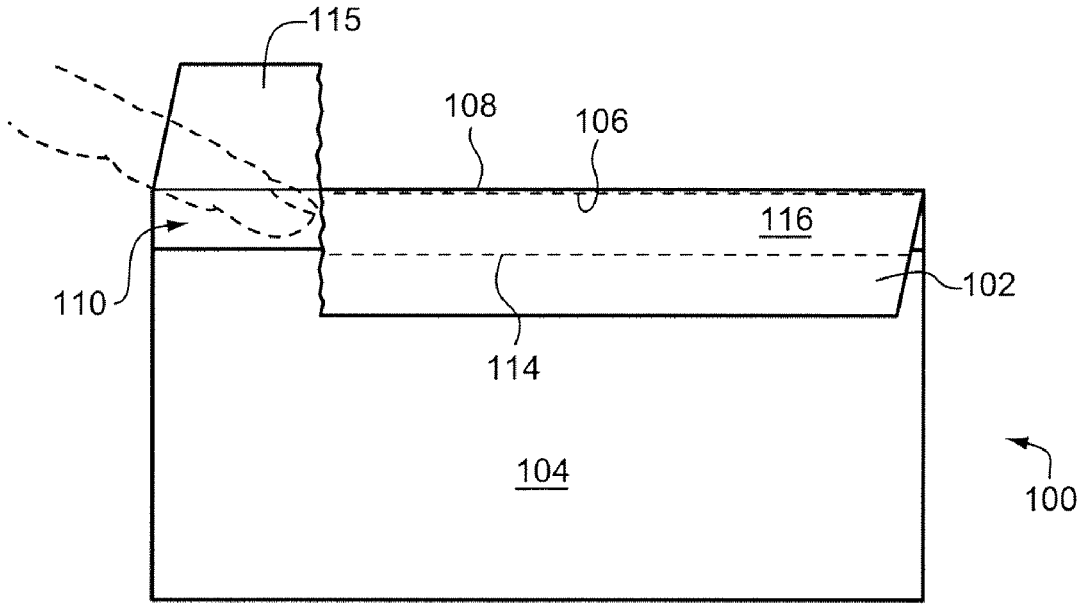
FIG. 8 is a plan view of the back side of the envelope shown in FIG. 7 but with a corner section of the sealing flap torn upwardly to permit insertion of a finger or tool for opening the envelope along the single perforated line or by pulling away a strip of material between the spaced perforation lines.

It will be understood, that the user of the envelope 10 will grasp a lower corner 34 of the corner section 22 of the sealing flap 14 and pull upwardly to tear the corner section 22 away from the back panel 12 somewhat as shown in FIG. 8. Then the user of the envelope can insert a finger or tool into the envelope 10 between the sealing flap 14 and the front panel and push the finger or tool against the fold line 26 or against the line of perforations 30 to open fully the envelope 10.

The strip of adhesive material 16 can be located in a marginal area 34 on the back panel 12, if desired.

Figure 3:
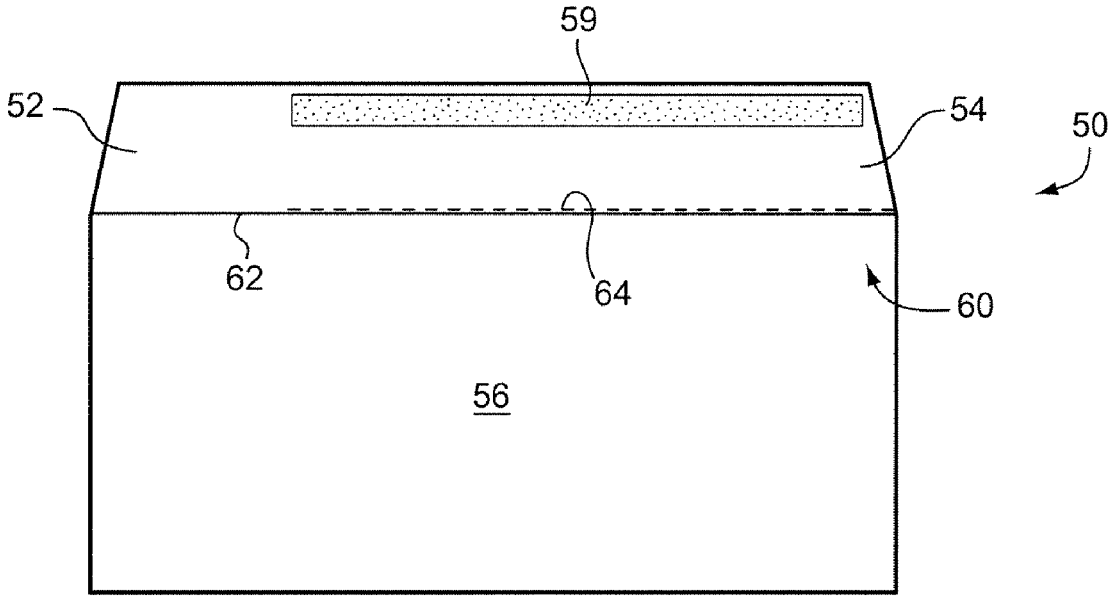
FIG. 3 is a plan view, similar to FIG. 1 of the back side of another envelope of the present invention where a transverse perforation line is omitted from the sealing flap.
Figure 4:
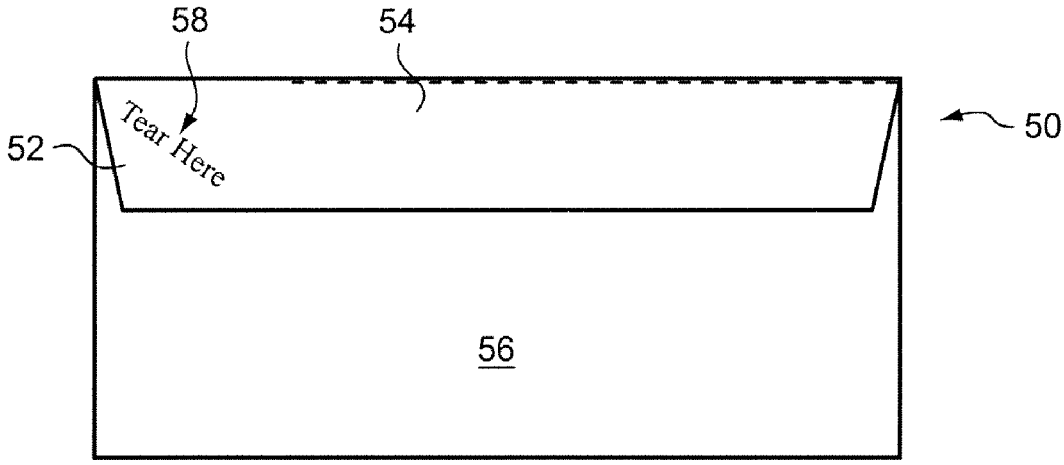
FIG. 4 is a plan view of the envelope shown in FIG. 3 after the sealing flapis sealed to the back panel, is similar to the view shown in FIG. 2, and shows the sealing flap sealed to the back panel of the envelope.

FIGS. 3 and 4 illustrate a modified envelope 50 modified from the envelope 10 shown in FIGS. 1 and 2. In this embodiment, to simply the construction of the envelope 10, the transverse line of perforations 24 is omitted such that a left hand corner section 52 of a sealing flap 54 is torn away from a back panel 56 without the aid of a weakened/perforated line of perforations 24. Again, of course, a strip of adhesive sealing material is situated on the sealing flap 54, but there is no adhesive sealing material 59 between the corner section 52 and the back panel 56 and a legend or indicia 58, such as "TEAR HERE" or "OPEN HERE" is placed on the outer surface of the corner section 52.

Again, It will be understood that the strip of adhesive sealing material 16 can be on the backside of the sealing flap 14 or 54 or on a marginal area 60 or 62 on the back panel 12 or 56 underlying the sealing flap 14 or 56 when the sealing flap 14 or 54 is folded over onto the back panel 14 or 56 of the envelope 10 or 50.

The envelope 50 also has a fold line 62 between the sealing flap 54 and the front panel and a line of perforations 64 at or adjacent the fold line 62 extending from a location adjacent one free side edge of the sealing flap 54 to at least the corner section 52.

Also, it is important to note that a key feature of the present invention is to limit the linear extent of the strip of adhesive sealing material 16 or 59 that extends across the envelope, e.g., on the sealing flap 14 or 56, which will underlie the sealing flap, but which does not extend into the corner section 22 or 52 of the envelope 10 or 50 whereby the corner section 22 or 52 easily can be torn away from the envelope 10 or 50 whether or not a line of transverse perforations 24 is provided in the sealing flap 14 or 56.

Figure 5:
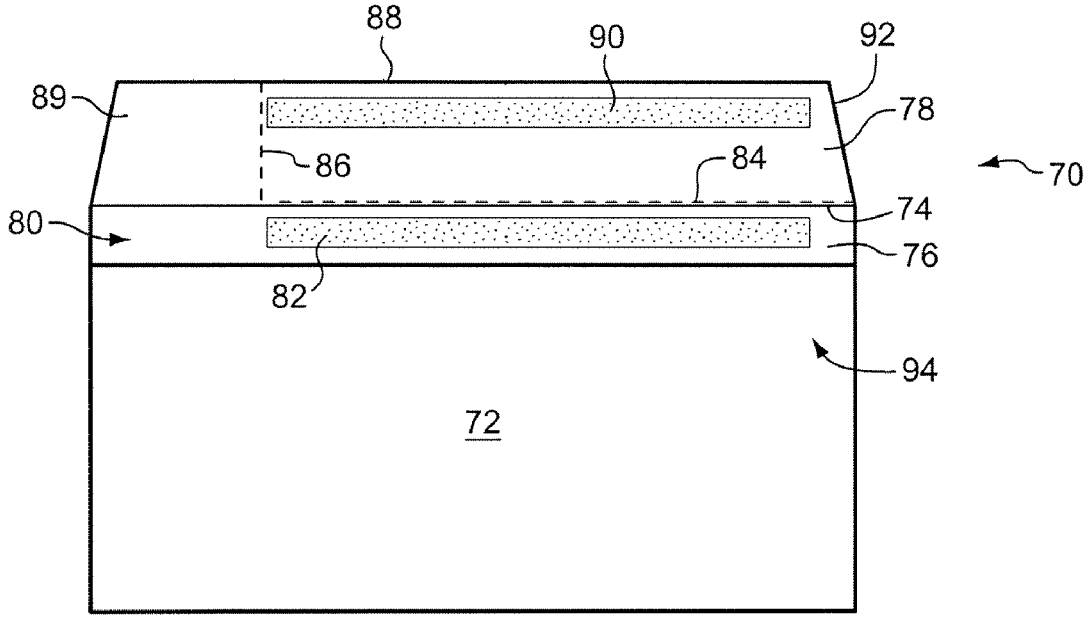
FIG. 5 is a plan view of the back side of still another embodiment of the envelope of the present invention where a marginal area is provided in the front panel of the envelope and has a strip of adhesive on the back side of the marginal area to form a resealing flap and where the sealing flap is hingedly connected to the top edge of the marginal area by a perforated line.

Referring now to FIG. 5, there is illustrated therein another embodiment of an easy open envelope 70 of the present invention. This envelope 70 is a re-useable or re-sealable envelope 70, since it is provided with a back panel 72, which only extends part way toward a fold line 74 between a front panel 76 of the envelope 70 and a sealing flap 78. The front panel 76 is provided with a marginal area 80 adjacent the fold line 74 and adjacent the sealing flap 78. The marginal area 80 has a strip of adhesive sealing material 82 thereon for use in sealing the marginal area 80 to the back panel 72 of the envelope 70 after the envelope 70 has been opened and the original sealing flap 78 has been torn away. While the strip of adhesive sealing material 82 is shown stopping at the beginning of a corner section 89, described below, the strip 82 can extend generally across the width of the envelope 70.

It will be noted that the back panel 72 only extends up to the beginning of the marginal area 80 of the front panel 76, and the marginal area 80 forms or defines a re-sealing flap 80.

At or adjacent the fold line 74 between the sealing flap 78 and the marginal area 80 of the front panel 72 there is provided a line of perforations 84 extending longitudinally across the envelope 70. Also, like in the embodiment shown in FIG. 1 a transverse line of perforations 86 is provided in the sealing flap 78 extending from the fold line 74 or line of perforations 84 to an outer free edge 88 of the sealing flap 78 to create a corner section 89 of the sealing flap 78 which is not adhered to the back panel 72. Also, as shown, a strip of adhesive sealing material 90 is provided on the sealing flap 78 and extends from one free side edge 92 of the sealing flap 78 substantially across the sealing flap 78 but not into the corner section 89.

Alternatively, and as explained above, the strip of adhesive sealing material 90 can be located in a marginal area 94 of the back panel 72 of the envelope 70 which underlies the sealing flap 78 when it is folded down and sealed to the back panel 74 of the envelope 70.

The back panel 72 of the envelope 70 extends over the marginal area 80 of the front panel 76 thereby to provide side openings in the envelope 70 between the sealing flap 78 and the front panel 76 where the marginal area 80 is located.

Figure 6:
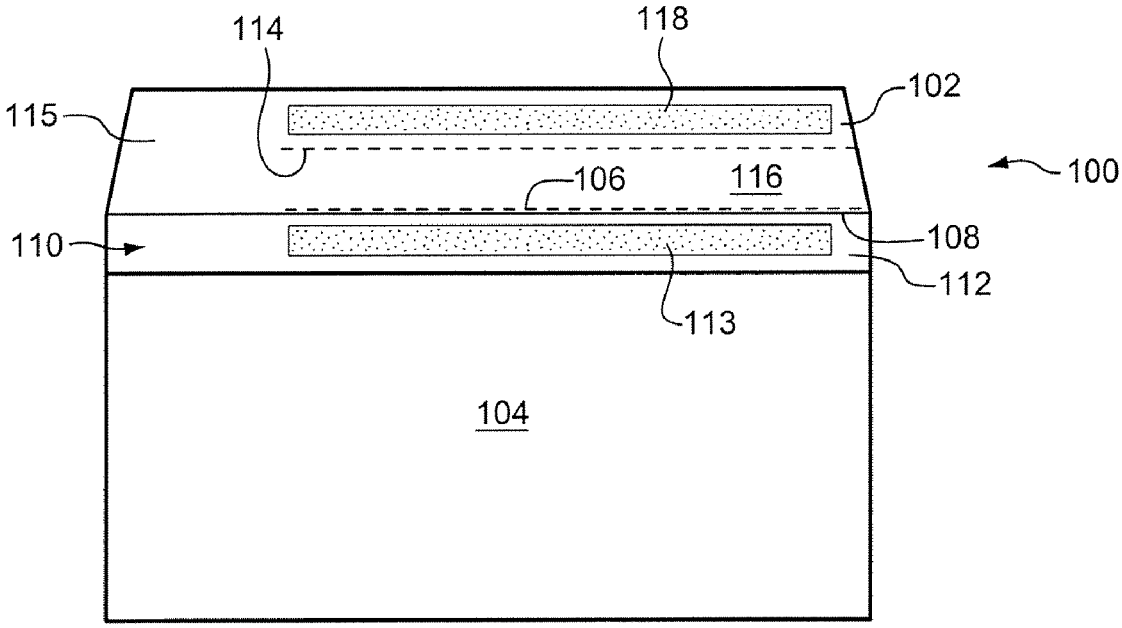
FIG. 6 is a plan view of the back side of a still further embodiment of the envelope of the present invention which is similar to the view shown in FIG. 5 but where a transverse perforated line is omitted from the sealing flap and a second line of perforations is provided in the sealing flap adjacent a strip of sealing adhesive located on the back side of the sealing flap and spaced from the perforated fold line a distance generally equal to the width of the marginal area on the front panel.

FIG. 6 shows a back side of a modified embodiment of an envelope 100 of the present invention with a sealing flap 102 folded up prior to sealing of the sealing flap 102 to a back panel 104 of the envelope 100. In this embodiment, the envelope 100 is not provided with a transverse line of perforations 86 in the sealing flap 102 but is provided not only with a first line of perforations 106 at or adjacent a fold line 108 between the sealing flap 102 and a marginal area 110 or re-sealing flap 110 of a front panel 112, having a strip of adhesive material 113 thereon, but also with a second line of perforations 114 spaced from and generally parallel to the fold line 108 or the first line of perforations 106 between the sealing flap 102 and the marginal area 110 in the front panel 112 of the envelope 100. A corner section 115 is not adhered to the back panel 104. An area or strip 116 between the lines of perforations 106 and 114 of the sealing flap 102 and juxtaposed to the re-sealing flap 110 provides a tear away strip 116 which can be torn away from the sealing flap 102 after it has been sealed by a strip of adhesive sealing material 118 to the back panel 104 when the envelope 100 is initially sealed. The strip of adhesive sealing material 118 extends across the sealing flap 102, but not into the corner section 115.

Like in FIG. 5, the strip of adhesive material 113 is shown extending up to but not into the corner section 115, like the strip of adhesive material 82. In this way a tear off rectangular corner can also be provided in the resealing flap 80 or 110 if desired.

It is believed however, that the embodiments where the strip of adhesive material 82 or 113 extends generally the width of the envelope 70 or 100 will be preferred.

Further, the strip of adhesive material 82 or 113 can be colored or flavored.

Figure 7:
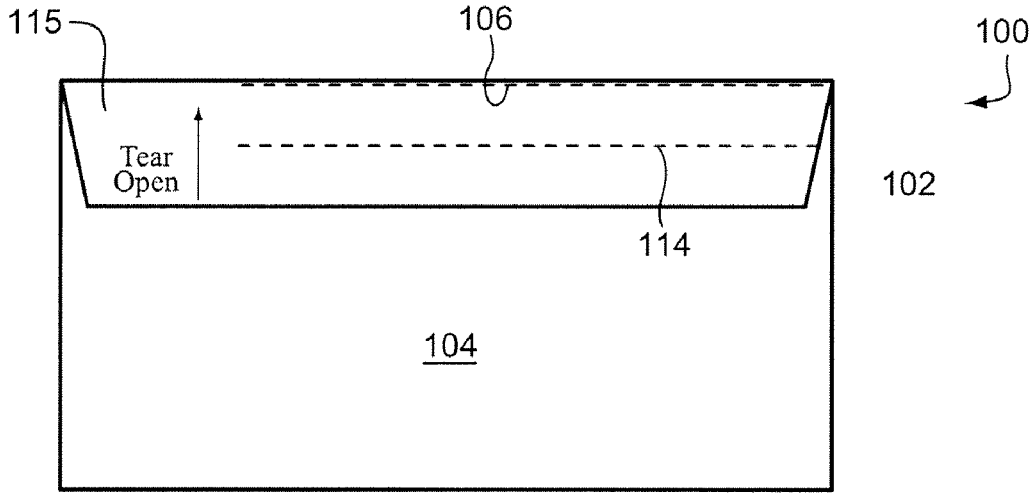
FIG. 7 is a plan view of the back side of the envelope shown in FIG. 5 or 6 with the sealing flap folded down and sealed to the back panel of the envelope.

FIG.7 is a plan view of the back side of the sealed envelope 100, that is, with sealing flaplO2 folded down and sealed to the back panel 104. Here, no transverse line of perforations 86 is shown in the sealing flap, although such a transverse line of perforations 86 is often preferred, as well as two lines of perforations 106 and 114.

FIG. 8 is a plan view of the back side of the envelope shown in FIG. 7 after a user has torn open the corner section 115 for facilitating further opening of the envelope 100 by pushing against the fold line 108 or line of perforations 106, with a finger or tool. At some point in the opening procedure, the user can grasp the strip 116 and pull, to complete opening of the envelope 100.

The line of perforations 84 or 106 is shown only extending to the corner section 89 or 115. However it is preferable in some embodiments to extend the line of perforations 84 or 106 all the way across the sealing flap 78 or 102 to a free side edge thereof or completely across the front panel 76 or 112 so the corner section 89 or 115 can be torn away from the marginal area 80 or 110 more easily to free the marginal area 80 or 110 for resealing to the back of the envelope 70 or 100.

After the corner section 115 and the strip 1 16 have been torn away from the envelope 100, a resealing flap is formed by the marginal area 110 in the front panel 112 of the envelope 100 and is ready for sealing of the adhesive strip 113 against the back side of the back panel 104 and remaining sealing flap 102 adhered to the back panel 104 of the envelope 100.

From the foregoing description, it will be understood that the easy open envelope of the present invention involves the locating of a strip of the adhesive sealing material, for sealing the sealing flap to a back panel of the envelope part way across the sealing flap or the back panel of the envelope but not into the one corner section of the envelope so that the corner section can be easily torn away from the envelope. If desired, the width of the strip of adhesive sealing material between the sealing flap an the back panel and at an inner edge of the corner section can be wider than at other areas along the length of the strip of adhesive sealing material to facilitate the tearing of the corner section away from the envelope.

Further, to facilitate use of the easy open envelope, a legend or direction such as "OPEN HERE" or "TEAR HERE" is provided on the outside surface of the corner section of the sealing flap of the envelope.

To further enable easy opening of the envelope, a transverse line of perforations can be provided in the sealing flap to facilitate the tearing away of the corner section of the sealing flap from the envelope.

It will be understood that the construction of the easy open envelope of the present invention only involves the use of sealing adhesive, fold lines and perforation lines and does not require a line, string, cord or wire to facilitate opening of the envelope.

The simplicity of the easy open envelope disclosed above facilitates opening of the envelope whether it is a regular envelope or a resealable envelope and does not require any extra material such as a string or cord and the manufacture of same easily can be incorporated into an existing envelope making machines which already have structures for creating fold lines, perforated lines, applying adhesive strips and applying printing to envelopes being formed by the machine.

Also, from the foregoing description it will be apparent that the easy open envelope of the present invention has a number of advantages a number of which have been described above and others of which are adherent in the invention.

In particular, the locating of the adhesive strip for sealing the sealing flap to the back panel of the envelope is an important feature of the invention and enables the corner section of the envelope to be torn away from the envelope for facilitating opening of the envelope. Such easy opening of the envelope is also facilitated by the legend or indicia such as "OPEN HERE" or "TEAR HERE". Further, easy opening of the envelope further an be facilitated by providing the transverse lines of perforations.

Accordingly, the scope of the invention is only to be limited as necessitated by the accompanying claims.

I claim:

1. An easy open envelope comprising:

a front panel and a back panel hingedly connected to one edge of said front panel;

a sealing flap hingedly connected to an opposite edge of said front panel at a fold line and having on an outer side of said sealing flap in one corner section thereof a legend or indicia indicating where to pull on said corner section of said sealing flap to open said envelope; and a strip of adhesive sealing material extending longitudinally, continuously across said envelope, but not in the area of said one corner section, said sealing flap having a line of perforations at said fold line extending parallel to said strip of adhesive, but not in said corner section and no string, cord or line member is provided in said envelope near or adjacent to said line of perforations or near or adjacent to said fold line, and no line of perforations extend in said sealing flap transverse to said fold line adjacent said corner section, whereby, once said sealing flap is sealed by said strip of adhesive material to said back panel, said sealed envelope easily can be opened, without the use of a string, cord or line member, by pulling on an edge of said corner section of said sealing flap having said legend or indicia to create an opening in said sealed envelope whereby a finger or tool can be inserted to open said envelope along said line of perforations.

2. The easy open envelope of claim 1, wherein said one corner section has said legend "OPEN HERE" thereon.

3. The easy open envelope of claim 1, wherein said strip of adhesive sealing material is placed on said sealing flap.

4. The easy open envelope of claim 1, wherein said one corner section has said legend "TEAR HERE" thereon.

* * * * *